US006394146B2

(12) United States Patent
Satou et al.

(10) Patent No.: US 6,394,146 B2
(45) Date of Patent: May 28, 2002

(54) SPLIT REED INCLUDING A WEAVING REED AND AN AUXILIARY REED HAVING A NON-PLANAR GUIDE PATH

(75) Inventors: Takeshi Satou; Akihiko Nakada; Shigeharu Sawada, all of Kanazawa (JP)

(73) Assignee: Tsudakoma Kogyo Kabushiki Kaisha, Kanazawa ( * ) Notice: Subject to any disclaimer, the term of this patent is extended or adjusted under 35 U.S.C. 154(b) by 0 days.

(21) Appl. No.: 09/855,616

(22) Filed: May 16, 2001

(30) Foreign Application Priority Data

May 30, 2000 (JP) ..... 2000-159779

(51) Int. Cl.[7] ..... D03D 49/62
(52) U.S. Cl. ..... 139/192; 139/434
(58) Field of Search ..... 139/192, 434, 139/302

(56) References Cited

U.S. PATENT DOCUMENTS 4,458,730 A * 7/1984 Benelli ..... 139/192
4,520,850 A * 6/1985 Cramer et al. ..... 139/194
5,253,681 A * 10/1993 Cramer et al. ..... 139/192
5,782,271 A * 7/1998 Wahhoud et al. ..... 139/192

FOREIGN PATENT DOCUMENTS

JP 9-268454 10/1997

* cited by examiner

*Primary Examiner*—Andy Falik
(74) *Attorney, Agent, or Firm*—Wenderoth, Lind & Ponack, L.L.P.

(57) ABSTRACT

A split reed has a weaving reed formed by successively arranging dents respectively provided with recesses forming a weft yarn guide path having a back surface, and an auxiliary reed respectively provided with recesses forming a weft yarn guide path having a back surface. The weaving reed and the auxiliary reed are attached to a slay or the respective dents of the weaving reed and the auxiliary reed are formed so that the back surface of the weft yarn guide path of the auxiliary reed is included in a plane behind a plane including the back surface of the weaving reed with respect to the cloth fell of a fabric on the loom when the weaving reed and the auxiliary reed are attached to the slay.

6 Claims, 6 Drawing Sheets

SPLIT REED INCLUDING A WEAVING REED AND AN AUXILIARY REED HAVING A NON-PLANAR GUIDE PATH

BACKGROUND OF THE INVENTION

1. Field of the Invention

The present invention relates to improvements in a split reed for a loom

2. Description of the Related Art

Referring to FIG. 1, a general split reed 1 includes a weaving reed 2 for weaving and an auxiliary reed 3. The weaving reed 2 and the auxiliary reed 3 are aligned in parallel to the cloth fell 31 of a woven fabric 30 and are spaced by a gap 22. When a weft yarn 16 picked by a main picking nozzle 28 passes the gap 22, the weft yarn 16 is subject to the influences of an air jet jetted through an auxiliary picking nozzle 29 and the forward movement of the split reed 1. Consequently, the picked weft yarn 16 deviates from a picking path in a direction away from the cloth fell 31, i.e., a direction toward a let-off motion, not shown, for feeding warp yarns 17.

A technique proposed in JP-A No. 9-268454 to solve such a problem forms a weft yarn guide path in each of the dents of a split reed for an air-jet loom. The shape of the dent is changed at the boundary of one section of the weft yarn guide path and another section of the same following the former is changed so that an inlet end part of the weft yarn guide path on a lower side with respect to a picking direction is flared toward an upper side with respect to the picking direction.

The manufacture of the prior art split reed including the dents, having a shape that changes stepwise needs complicated processes and hence is very expensive. More over, it is difficult to form an accurately smoothly tapered picking path by arranging the dents having a shape that changes stepwise and the weft yarn will not be properly inserted unless the picking path is formed in a smoothly tapered shape.

SUMMARY OF THE INVENTION

Accordingly, it is an object of the present invention to provide a split reed including a weaving reed for beating up a picked weft yarn and an auxiliary reed disposed in a region in which any warp yarns are not extended on an arriving side of a loom opposite a picking side of the loom, and capable of guiding a picked weft yarn so that the picked weft yarn is able to travel stably toward the arriving side.

With the foregoing object in mind, a split reed according to one aspect of the present invention includes a weaving reed and an auxiliary reed; wherein the weaving reed and the auxiliary reed are disposed so that the back surface of a weft yarn guide path formed in the auxiliary reed is included in a plane behind a plane including the back surface of a weft yarn guide path formed in the weaving reed, i.e., on the side of a let-off motion included in the loom with respect to the back surface of the weft yarn guide path of the weaving reed, and the respective weft yarn guide paths of the weaving reed and the auxiliary reed have a substantially rectangular cross section and are defined by an upper surface, a lower surface and a back surface.

According to a first aspect of the present invention, a split reed for a loom comprises: a weaving reed disposed in a region where warp yarns are extended and defining a weft yarn guide path; and an auxiliary reed separated from the weaving reed, disposed in a region on an arriving side of the loom in which any warp yarns are not extended and forming a weft yarn guide path; wherein a plane including the back surface of the weft yarn guide path of the auxiliary reed is behind a plane including the back surface of the weft yarn guide path of the weaving reed with respect to the cloth fell of a woven fabric woven on the loom.

In the split reed, it is preferable that the auxiliary reed is formed by arranging dents of the same shape as that of those forming the weaving reed, and the auxiliary reed is disposed at a position on a slay behind a position where the weaving reed is disposed on the slay with respect to the cloth fell.

In the split reed, it is preferable that the auxiliary reed is formed by arranging dents of the same shape as that of those forming the weaving reed, and the lower end of the auxiliary reed is attached to a reed holding member so that the auxiliary reed is positioned behind the weaving reed with respect to the cloth fell.

In the split reed, it is preferable that the auxiliary reed is formed by arranging dents different from those forming the weaving reed, and the back surface of the weft yarn guide path of the auxiliary reed is included in a plane behind a plane including the back surface of the weft yarn guide path of the weaving reed with respect to the cloth fell.

In the split reed, it is preferable that the auxiliary reed is formed by arranging dents different from those forming the weaving reed, the back surface of the weft yarn guide path of the auxiliary reed is included in a plane behind a plane including the back surface of the weft yarn guide path of the weaving reed with respect to the cloth fell, and the auxiliary reed is disposed at a position on a slay behind a position where the weaving reed is disposed on the slay with respect to the cloth fell.

In the split reed, it is preferable that the auxiliary reed is formed by arranging dents different from those forming the weaving reed, the back surface of the weft yarn guide path of the auxiliary reed is included in a plane behind a plane including the back surface of the weft yarn guide path of the weaving reed with respect to the cloth fell, and the lower end of the auxiliary reed is attached to a reed holding member so that the auxiliary reed is positioned behind the weaving reed with respect to the cloth fell.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
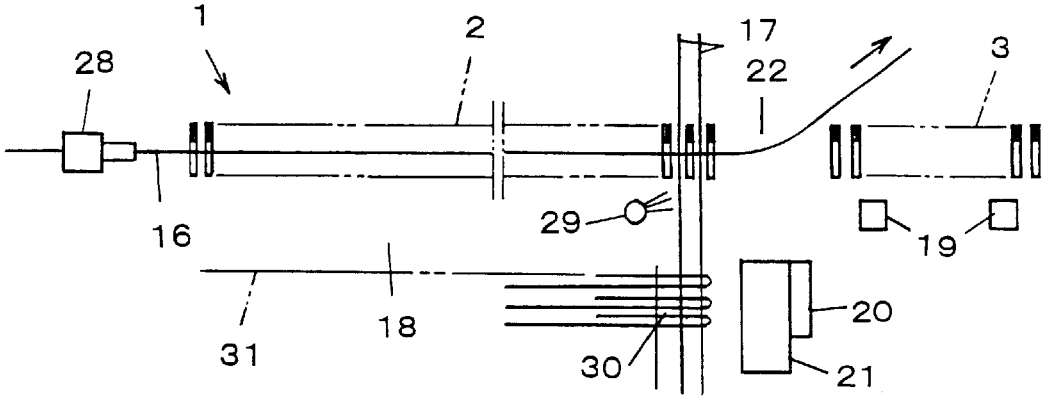
FIG. 1 (PRIOR ART)
FIG. 1 is a schematic view of a prior art split reed.
Figure 2:
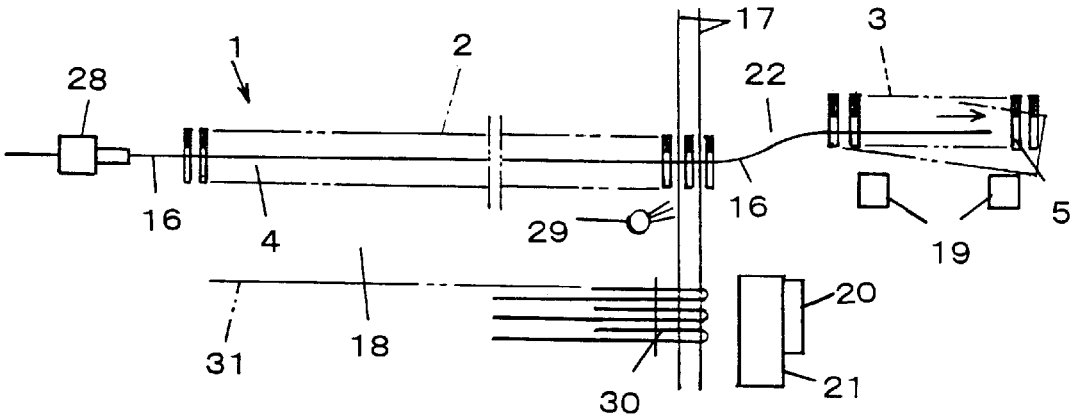
FIG. 2 is a schematic view of a split reed in a preferred embodiment according to the present invention including a weaving reed and an auxiliary reed.
Figure 3:
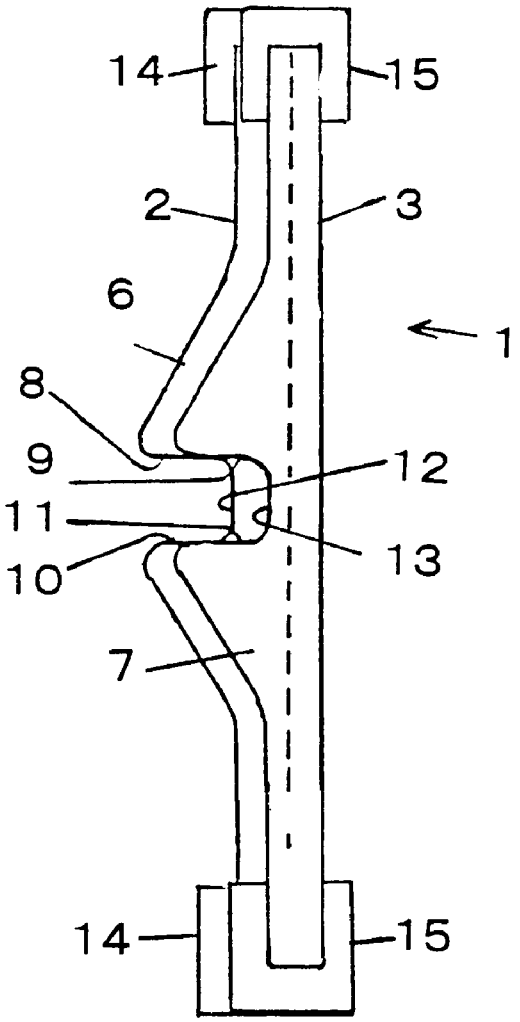
FIG. 3 is a side elevation of assistance in explaining the positional relation between the weaving reed and the auxiliary reed of the split reed shown in FIG. 2.
Figure 5:
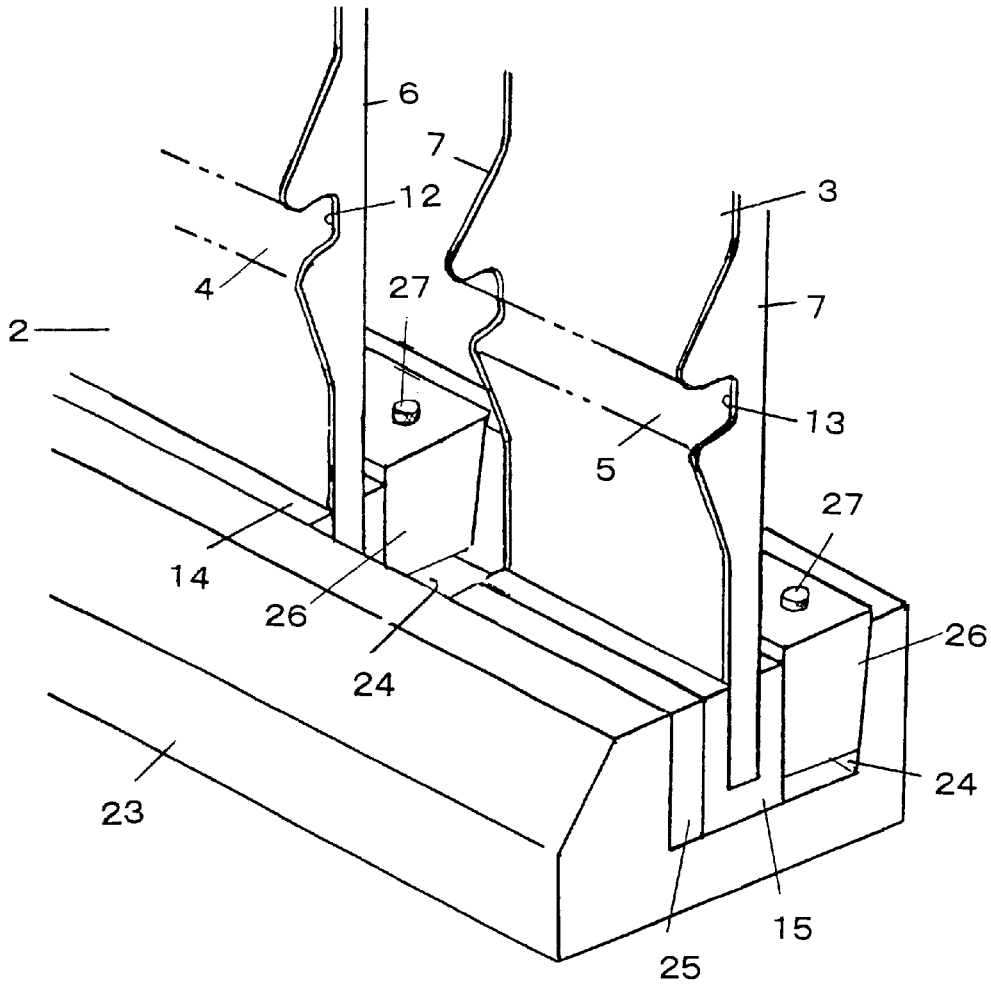
FIG. 5 is a perspective view of the weaving reed and the auxiliary reed of the split reed shown in FIG. 2 as mounted on a slay.

Referring to FIGS. 2 and 3, a split reed 1 in a preferred embodiment according to the present invention for a loom includes a weaving reed 2 and an auxiliary reed 3. The weaving reed 2 is disposed in a region where warp yarns 17 are extended and the auxiliary reed 3 is disposed in a region where any warp yarns are not extended on an arriving side opposite a picking side and is spaced from the weaving reed 2. As shown in FIG. 5, a weft yarn guide path 4 is formed in the weaving reed 2 and a weft yarn guide path 5 is formed in the auxiliary reed 3 so as to be continuous with the weft yarn guide path 4 of the weaving reed 2. The weft yarn guide paths 4 and 5 are on the level of a cloth fell 31 in a fabric 30 being woven on the loom. The weaving reed 2 is formed by fixing the upper and lower ends of a plurality of dents 6 to dent holding members 14, respectively, and the auxiliary reed 3 is formed by fixing the upper and the lower ends of a plurality of dents 7 to dent holding members 15, respectively. The weft yarn guide path 4 of the weaving reed 2 is a successive arrangement of substantially rectangular recesses formed in parts of the dents 6 and is defined by an upper surface 8, a lower surface 10 and a back surface 12. The weft yarn guide path 5 of the auxiliary reed 3 is a successive arrangement of substantially rectangular recesses formed in parts of the dents 7 and has an upper surface 9, a lower surface 11 and a back surface 13. The back surface 13 of the weft yarn guide path 5 of the auxiliary reed 3 is included in a plane behind a plane including the back surface 12 of the weft yarn guide path 4 of the weaving reed 2 with respect to the cloth fell 31. A gap 22 of a proper width is formed between the weaving reed 2 and the auxiliary reed 3 to avoid the interference of the split reed 1 with a cutter 20 and a tuck-in device 21.

Referring again to FIGS. 2 and 3, a weft yarn 16 is picked into a shed 18 formed by the wrap yams 17 by a main picking nozzle 28. The picked weft yarn 16 is assisted for flying toward the arriving side through the weft yarn guide path 4 of the weaving reed 2 by a fluid jetted through a plurality of auxiliary nozzles 29 and reaches the weft yarn guide path 5 of the auxiliary reed 3 disposed below the weaving reed 2 with respect to a picking direction. When a weft feeler 19 is disposed opposite to the auxiliary reed 3 detects the picked weft yam 16, it is decided that the weft yarn 16 has been inserted properly in the shed 18. The properly inserted weft yarn 16 is beaten up into the cloth fell 31 of the fabric 30 by the beating-up motion of the split reed 1 (the weaving reed 2 and the auxiliary reed 3). After the beating-up motion has been completed, the weft yarn 16 is cut at a position between the weaving reed 2 and the auxiliary reed 3 by the cutter 20. An end part of the weft yarn 16 extending from a selvage of the fabric 30 is tucked into the shed 18 of the warp yarns 17 by the tucking-in operation of the tuck-in device 21 to form the selvage of the fabric 30.

As mentioned above, the back surface 13 of the weft yarn guide path 5 of the auxiliary reed 3 is included in a plane behind a plane including the back surface 12 of the weft yarn guide path 4 of the weaving reed 2 with respect to the cloth fell 31. Therefore, the leading end part of the picked weft yarn 16 is able to enter the weft yarn guide path 5 of the auxiliary reed 3 without fail even if the leading end part of the weft yarn 16 passing through the gap 22 between the weaving reed 2 and the auxiliary reed 3 is deviated in a direction away from the cloth fell 31 by the influence of an air jet jetted through the auxiliary nozzle 29 or the advancement of the split reed 1. In this embodiment, the dents 7 of the auxiliary reed 3 have the same shape. Therefore, the weft yarn guide path 5 of the auxiliary reed 3 can be formed accurately smoothly tapered shape without difficulty.

Figure 4:
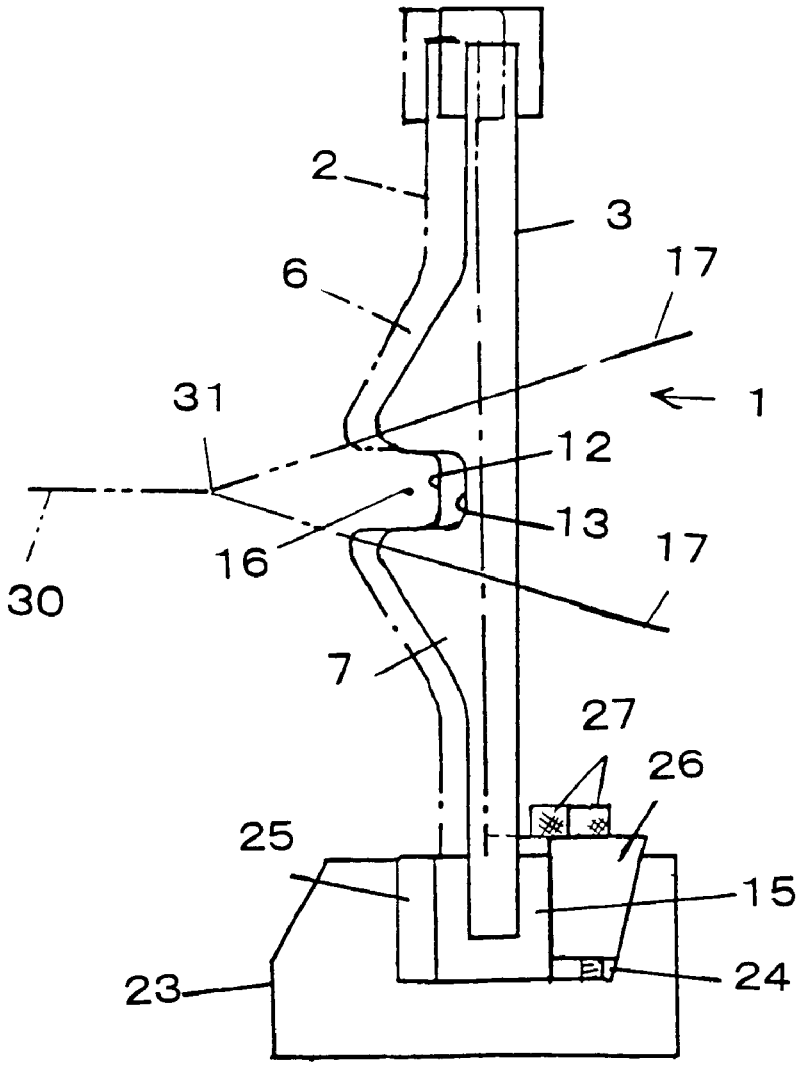
FIG. 4 is a side elevation of the split reed shown in FIG. 2 as mounted on a slay.

FIGS. 4 to 7 are views of assistance in explaining a method of attaching the split reed 1 including the weaving reed 2 and the auxiliary reed 3 to a slay 23. Referring to FIGS. 4 and 5, the dents 7 of the auxiliary reed 3 are the same in shape as the dents 6 of the weaving reed 2. The position of the auxiliary reed 3 on the slay 23 is behind the position of the weaving reed 2 on the slay 23 with respect to the cloth fell 31; that is the auxiliary reed 3 is shifted from a position corresponding to the weaving reed 2 toward a let-off motion for letting off the warp yarns 17.

The lower dent holding member 14 holding the weaving reed 2 is placed in a groove 24 formed in the slay 23 in contact with the front side surface of the groove 24, large wedges 26 are driven into a space between the back surface of the dent holding member 14 and the back side surface of the groove 24, and the wedges 26 are fixed in place with bolts 27. The lower dent holding member 15 holding the auxiliary reed 3 is placed in the groove 24 in contact with the back side surface of the groove 24, shims 25 are inserted in a space between the front surface of the dent holding member 15 and the front side surface of the groove 24, small wedges 26 are driven into a space between the back surface of the dent holding member 15 and the back side surface of the groove 24 and the small wedges 26 are fixed in place with bolts 27. Thus the back surface 13 of the weft yarn guide path 5 of the auxiliary reed 3 is included in a plane spaced a distance corresponding to the thickness of the shims 25 apart behind a plane including the back surface 12 of the weft yarn guide path 4 of the weaving reed 2.

Figure 6:
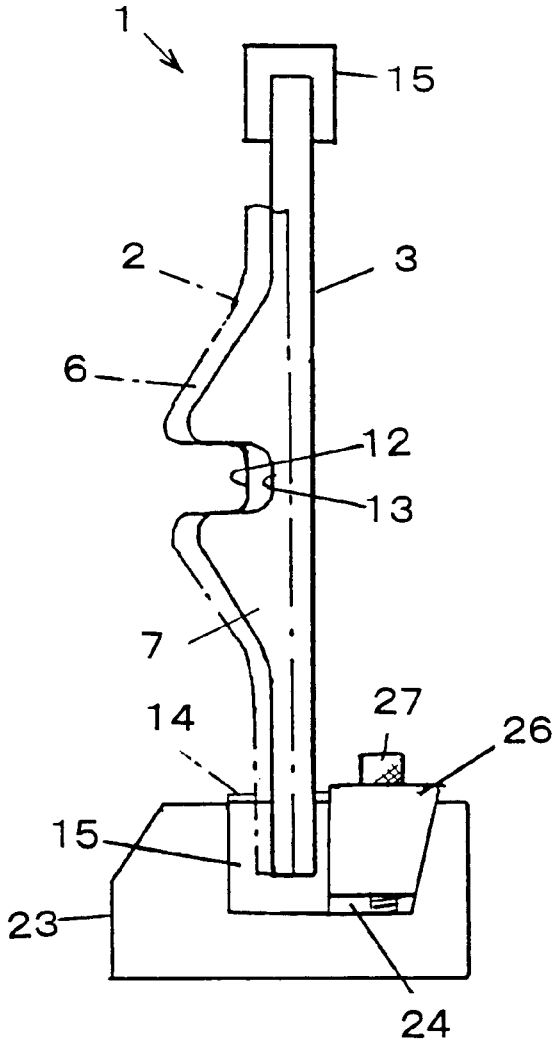
FIG. 6 is a view of assistance in explaining another method of disposing the weaving reed and the auxiliary reed of the split reed mounted on a slay.

In an arrangement shown in FIG. 6, the dents 7 of the auxiliary reed 3 are the same in shape as the dents 6 of the weaving reed 2. The dent holding members 14 and 15 are the same in shape, except that the distance between the front surface of the dent holding member 14 and a groove formed in the dent holding member 14 to receive the dents 6 of the weaving reed 2 is shorter than the distance between the front surface of the dent holding member 15 and a groove formed in the dent holding member 14 to receive the dents 6 of the auxiliary reed 3.

Figure 7:
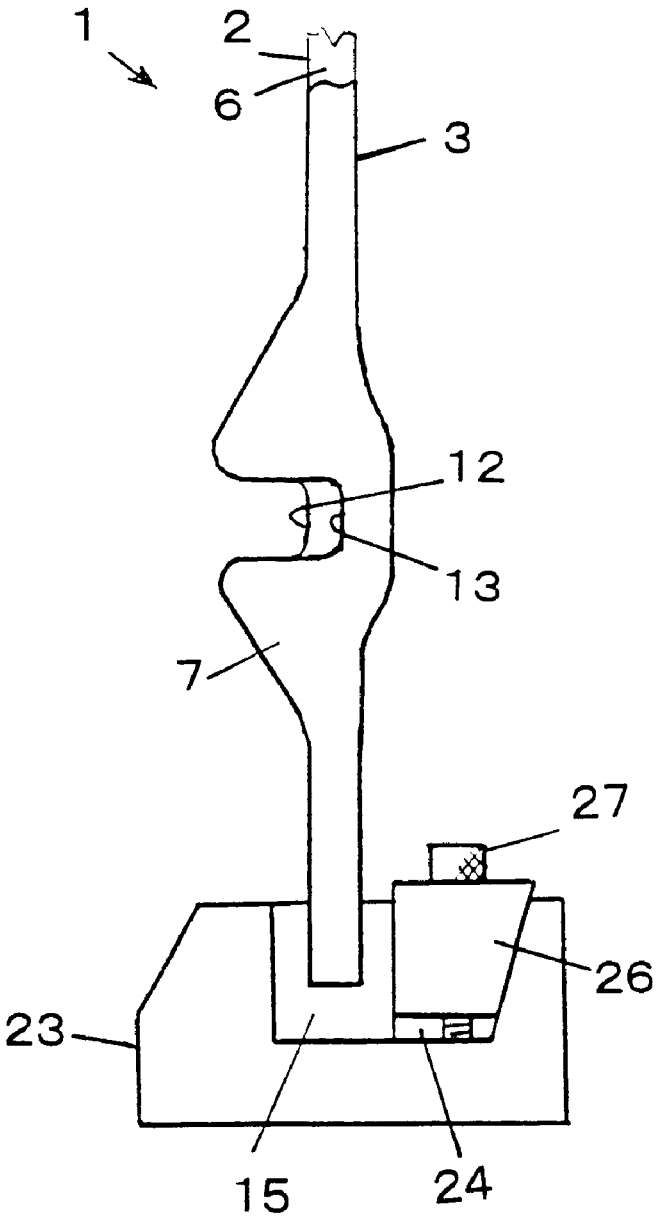
FIG. 7 is a view of assistance in explaining a third method of disposing the weaving reed and the auxiliary reed of the split reed on a slay.

In an arrangement shown in FIG. 7, the weaving reed 2 and the auxiliary reed 3 are disposed on a slay 23 at the same position with respect to a direction perpendicular to the picking direction, and the dents 6 of the weaving reed 2 and dents 7 of the auxiliary reed 3 have different shapes, respectively. The back surface 13 of the weft yarn guide path 5 of the auxiliary reed 3 is included in a plane spaced a distance apart behind a plane including the back surface 12 of the weft yarn guide path 4 of the weaving reed 2. If necessary, a part of each dent 7 behind the back surface 13 may be protruded backward to reinforce the dent 7 because the depth of the recess formed in each dent 7 to define the weft yarn guide path 5 is deeper than that of the recess formed in each dent 6 to define the weft yarn guide path 4. The dents 6 and 7 shown in FIG. 7 may be positioned by a method similar to that previously described with reference to FIGS. 4 and 5 or may be positioned by a method similar to that previously described with reference to FIG. 6. The auxiliary reed 3 may be attached to the slay 23 so as to incline to the cloth fell 31 as indicated by two-dot chain lines in FIG. 2.

Since the present invention has the following effects. The back surface of the weft yarn guide path of the auxiliary reed is included in a plane behind a plane including the back surface of the weft yarn guide path of the weaving reed with respect to the cloth fell, a leading end part of the picked weft yarn is able to enter the weft yarn guide path of the auxiliary reed without fail even if the leading end part of the weft yarn passing through the gap between the weaving reed and the auxiliary reed is deviated in a direction away from the cloth fell by the influence of an air jet jetted through the auxiliary nozzle or the advancement of the split reed.

When the dents of the auxiliary reed are of the same shape, the auxiliary reed is free from a problem that it is difficult to form 'an accurately smoothly tapered picking path'. When the weaving reed and the auxiliary reed are formed of the same dents, the weaving reed and the auxiliary reed can be efficiently manufactured at a low cost because all the dents can be efficiently formed by the same process at a low cost.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. A split reed for a loom, comprising:

a weaving reed disposed in a region where warp yarns are extended and defining a weft yarn guide path; and an auxiliary reed separated from the weaving reed, the auxiliary reed being disposed in a region on an arriving side of the loom in which any warp yarns are not extended and forming a weft yarn guide path;

wherein a plane including a back surface of the weft yarn guide path of the auxiliary reed is behind a plane including a back surface of the weft yarn guide path of the weaving reed with respect to a cloth fell of a fabric woven on the loom.

2. The split reed according to claim 1, wherein the auxiliary reed is formed by arranging dents of the same shape as that of those forming the weaving reed, and the auxiliary reed is disposed at a position on a slay behind a position where the weaving reed is disposed on the slay with respect to the cloth fell.

3. The split reed according to claim 1, wherein the auxiliary reed is formed by arranging dents of the same shape as that of those forming the weaving reed, and a lower end of the auxiliary reed is attached to a lower reed holding member so that the auxiliary reed is positioned behind the weaving reed with respect to the cloth fell.

4. The split reed according to claim 1, wherein the auxiliary reed is formed of an arrangement of first dents, wherein the weaving reed is formed of an arrangement of second dents, and wherein the first dents are different in relation to the second dents.

5. The split reed according to claim 1, wherein the auxiliary reed is formed of an arrangement of first dents, wherein the weaving reed is formed of an arrangement of second dents, wherein the first dents are different in relation to the second dents, and wherein the auxiliary reed is disposed at a position on a slay behind a position where the weaving reed is disposed on the slay with respect to the cloth fell.

6. The split reed according to claim 1, wherein the auxiliary reed comprises a lower end, and is formed of an arrangement of first dents, wherein the weaving reed comprises a lower end, and is formed of an arrangement of second dents, wherein the first dents are different in relation to the second dents, and wherein lower ends of the weaving reed and the auxiliary reed are attached to reed holding members, respectively, so that the auxiliary reed is positioned behind the weaving reed on a slay with respect to the cloth fell.

* * * * *